United States Patent [19]

Cusack

[11] Patent Number: 4,804,314

[45] **Date of Patent: * Feb. 14, 1989**

[54] MAGNETOSTRICTIVE HYDRAULIC INJECTOR

[75] Inventor: Robert F. Cusack, Grosse Pointe, Mich.

[73] Assignee: GTE Valeron Corporation, Troy, Mich.

[ * ] Notice: The portion of the term of this patent subsequent to Feb. 23, 2005 has been disclaimed.

[21] Appl. No.: 904,447

[22] Filed: Sep. 8, 1986

Related U.S. Application Data

[63] Continuation-in-part of Ser. No. 758,991, Jul. 25, 1985, abandoned, and a continuation-in-part of Ser. No. 759,395, Jul. 26, 1985, abandoned.

[51] Int. Cl.[4] ..... F04B 17/00; F04B 35/00

[52] U.S. Cl. ..... 417/322; 417/417; 310/26

[58] Field of Search ..... 417/322, 410, 417, 505; 310/26

[56] References Cited

U.S. PATENT DOCUMENTS

| | | | |
|---|---|---|---|
| 1,092,453 | 4/1914 | Rainey | 310/26 |
| 2,772,862 | 12/1956 | Van Suchtelen | 310/26 |
| 2,776,417 | 1/1957 | Harris | 310/26 |
| 2,842,067 | 7/1958 | Stevens | 310/26 |
| 3,175,132 | 3/1965 | Salter | 310/26 |
| 3,194,162 | 7/1965 | Williams | 417/322 |
| 3,349,304 | 10/1967 | Wachter | 310/26 |
| 3,391,680 | 7/1968 | Benson | 417/322 |
| 4,096,735 | 6/1978 | Huntzinger et al. | 310/26 |

*Primary Examiner*—Donald E. Stout
*Attorney, Agent, or Firm*—David J. Koris

[57] ABSTRACT

A magnetostrictive hydraulic injector pump having a cylinder closed at one end with an elongated piston arranged within the cylinder from the other end. The piston is constructed of a magnetostrictive material which increases in length in the presence of a magnetic field of appropriate intensity. It is wound along its length with a coil of wire capable of producing an electro-magnetic field. The piston includes an intake passage communicating with a fluid supply. The piston is fastened at the open end of the cylinder to define a cylinder cavity between the cylinder closed end and the piston. An injector passage including a valve, communicates with this cavity to the exterior. The volume of this cavity is reduced when the piston expands under the influence of the magnetic field created by the coil to produce a pressure on any fluid contained within said cavity to force it out the injector passage.

In a preferred embodiment the cylinder is constructed of a negative magnetostrictive material which contracts in length in the presence of a magnetic field. Thus, upon the energization of the coil the cylinder shrinkage and the pistons expansion double the relative movement of the piston face to increase the volume displacement of the pump.

5 Claims, 1 Drawing Sheet

MAGNETOSTRICTIVE HYDRAULIC INJECTOR

CROSS REFERENCE TO RELATED APPLICATION

This application is a continuation-in-part of U.S. patent applications Ser. Nos. 758,991, filed 7/25/85 and 759,395, filed 7/26/85, both now abandoned.

This application is related to the following copending applications of applicant filed at the same time and assigned to the same assignee:

Dual Magnetostrictive Pump Ser. No. 905,006

Magnetostrictive Pump with Reversible Valves Ser. No. 905,007

Dual Magnetostrictive Pump with Hydraulic Cylinder Ser. No. 918,220 now U.S. Pat. No. 4,726,741.

FIELD OF THE INVENTION

This invention relates to a fluid injector pump and more particularly to an injector using a reciprocating piston pump wherein the piston is reciprocated magnetostrictively.

BACKGROUND OF THE INVENTION

It is known in the present state of the art to provide magnetically actuated injector pumps wherein an electromagnet is used to reciprocate a piston or flexible diaphragm through suitable linkage to provide the required volumetric displacement. These types of injector pumps however do not readily adapt themselves to applications where they are required to produce measured amounts of fluid at high pressures.

It is also known that certain metals when placed in a magnetic field react by changing their dimensions. This effect is known as magnetostriction. A more thorough discussion of this phenomenon may be found in the book authored by Richard M. Bozorth titled "Ferro-Magnetism" and published by the D. Van Nostrand Co. Inc. (Sept. 1968).

SUMMARY OF THE INVENTION

Accordingly, it is an object of the present invention to produce a hydraulic injector pump capable of producing a pressure to eject the fluid utilizing the magnetostrictive effect.

It is another object of the present invention to produce such a pump which is readily and economically manufactured.

It is a further object of the present invention that the injector pump output a constant volume displacement for each operation.

It is yet another object of the present invention to utilize both the positive expansive, and the negative contractive magnetostrictive qualities in a single application.

These and other objects and features of the present inventions are accomplished in a simple cylindrical injector pump having a piston of positive magnetostrictive material wrapped in an electromagnet and fastened at one end to the cylinder, with the other end free within the cylinder to move axially. In an alternate embodiment the cylinder is constructed of a magnetostrictive material having a negative magnetostrictive quality. The pump cylinder is closed at the end facing the pistons free end to enclose a cylinder cavity. By the provision of an ejector passage, the piston ends reciprocating motion results in a pumping action to eject a fluid governed by the strength of the magnetic field created by the coil and the constants of the metal used to make the piston and in the alternate embodiment of the cylinder.

BRIEF DESCRIPTION OF THE DRAWING

For a more complete understanding of the invention, reference may be had to the following detailed description of the invention in conjunction with the drawing wherein.

DESCRIPTIVE OF THE PREFERRED EMBODIMENTS

Figure 1:
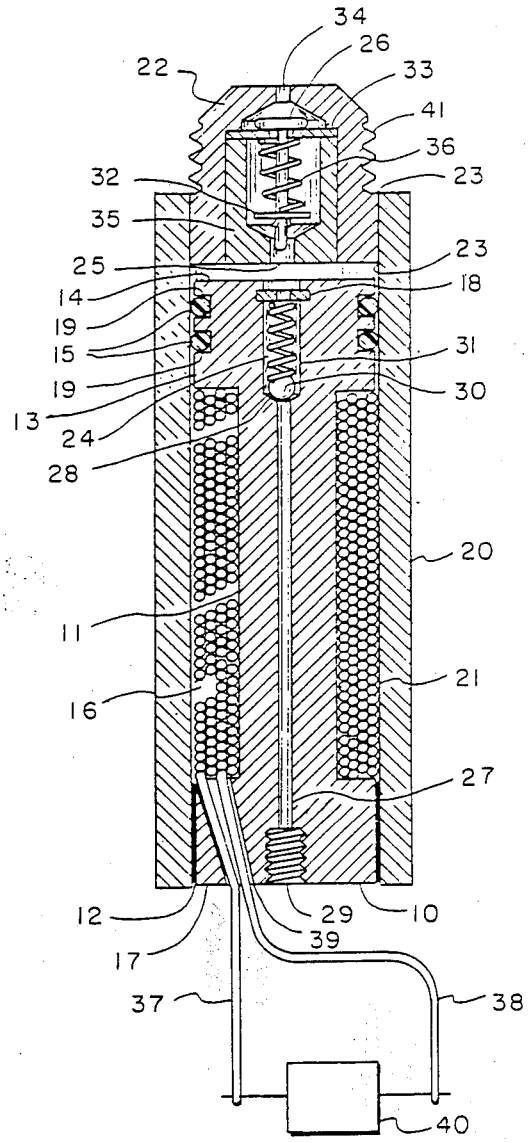
FIG. 1 illustrates in a sectional view the structure of the novel injector pump having an electro-magnetic coil wound about the piston.

The novel magnetostrictive injector of the present invention as shown in FIG. 1 consists of a cylindrical housing 20 with a coaxial piston 10 within it. The piston 10 is fastened at its base end to the cylindrical housing's inner surface 21 at interface 12. The piston somewhat resembles a spool in that it has an axial recess 11 along its outer surface to receive a magnetizing coil 16 wound around it as a core. The coil terminals 37 and 38 are taken out via a passage 39 and may be connected to an energizing and control source shown at box 40. The unrecessed ends of the piston, the base end 17 and the piston face end 13 contain the coil as spool ends. The piston face end 13 as shown, has two circumferential grooves 15 dimensioned to receive a pair of piston ring seals 19.

Referring to FIG. 1, the cylindrical housing 20 of the pump further includes a cylinder head 22 through which the fluid is ejected, suitably fastened to the cylindrical housing's inner surface 21 at the cylinder head interface 23. Within the cylinder head 22 is included an output valve. The output valve assembly consists of the valve member 26 seated in a valve seat 33. The valve is held in place by a resilient spring 36, which in turn is restricted by a disc 32 and a swage on the valve stem. The cylinder head 22 may include means along its outer surface 41 for facilitating mounting onto a suitable structure. An intake valve assembly 35 is located in an enlarged cavity 31 within the piston and terminated at the cylinder interior. A passage 27 extends to the exterior end and is terminated by a valve seat 28, and to passage 29, arranged for ready connection to connecting equipment or conduit. The valve itself consists of a ball 30 and a resilient spring assembly 24 urging the ball 30 against the seat 28. The spring is retained in its place by a retaining member 18. The valve arrangement as shown is only by way of example for other suitable valve configurations may be used. Piston 10 is constructed of a material that has the property of expanding in the direction of an applied magnetic field. An alloy consisting of 49% Cobalt, 49% Iron and 2% Vanadium more generally known as 2V Permadur is a material that has such a property and provides a displacement of 60 micro inches per inch of length. The cylinder is also constructed of a magnetostrictive material, but of a negative characteristic that is it contracts in a magnetic field.

In operation, the magnetic field is supplied by the magnetizing coil 16 causes the piston 10 to expand lengthwise in the direction of magnetization to displace any fluid contained between the piston face 14 and the cylinder head surface 23 forcing the fluid out through the fluid passage 25 past the valve member 26 and through the injector port 34.

If the preferred embodiment is utilized, the cylinder is constructed of a negative magnetostrictive such as metal nickel which provides a displacement of 35 micro inches per inch of length with a magnetic field of 250H. The particular selection of a magnetostrictive material having expansion qualities for the piston and a material having contracting qualities for the cylinder is only by way of example since inversely the piston may be constructed of a material having contractive qualities and the cylinder of a material having expansive qualities and still result in a pumping action having the resultant combined movement.

Upon cessation of the current flow through coil 16, the magnetic field within the coil collapses and the piston 10 responds by shrinking back in size to its initial length. This action reduces the pressure within the cylinder, drawing in additional fluid from passage 29 past the ball 30 in intake valve assembly 35.

In the preferred embodiment, the cessation of the current flow through coil 16, causes the magnetic field to collapse resulting in the expansion of the cylinder and the contraction of the piston back to their initial length. This cycle of operation can then be repeated any number of times as required to inject the desired amount of fluid. This injector pump readily lends itself to step or digital control in that a measured amount of fluid is passed for each applied pulse. Thus, it is readily adaptable as a prime source for programmed lubrication of automatic machinery and may even be adapted for use as a fuel injector.

While but a few embodiments of the present invention have been shown, it will be obvious to those skilled in the art that numerous modifications may be made without departing from the spirit of the present invention. The invention therefore should be limited only by the scope of the claims appended hereto.

What is claimed is:

1. A fluid injector pump assembly comprising: a cylinder having a first and a second end, said cylinder formed of a negative magnetostrictive material, an elongate piston of a length shorter than said cylinder and having a first and second end, said piston formed of a positive magnetostrictive material, said first end of said piston secured to said first end of said- cylinder, said piston including an inlet passage with head valve means, a cylinder head secured to said cylinder second end and having an injection port including valve means, and a means to interruptedly apply a magnetic field to said assembly, said piston operated responsive to said magnetic field to expand and expel any fluid located between said piston and head via said injection port past said head valve.

2. A fluid injector pump assembly as claimed in claim 1 wherein said piston contracts and said cylinder expands each to its original length upon collapse of said magnetic field to draw in any fluid at said inlet passage.

3. A fluid injector pump assembly as claimed in claim 1 wherein said piston includes a circumferentially depressed section between its ends and said means to interruptedly apply a magnetic field comprises a magnetic coil located in said depressed section.

4. A fluid injector pump assembly as claimed in claim 1 wherein said piston is formed of an alloy consisting of 49% Cobalt, 49% Iron and 2% Vanadium.

5. A fluid injector pump assembly as claimed in claim 1 wherein said cylinder is formed of nickel.

* * * * *